US008923719B2

(12) United States Patent
Shimizu

(10) Patent No.: US 8,923,719 B2
(45) Date of Patent: Dec. 30, 2014

(54) FIXING DEVICE AND IMAGE FORMING DEVICE

(71) Applicant: Yosuke Shimizu, Toyokawa (JP)

(72) Inventor: Yosuke Shimizu, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 210 days.

(21) Appl. No.: 13/685,767

(22) Filed: Nov. 27, 2012

(65) Prior Publication Data

US 2013/0142533 A1 Jun. 6, 2013

(30) Foreign Application Priority Data

Dec. 2, 2011 (JP) ..... 2011-265087

(51) Int. Cl.
*G03G 15/20* (2006.01)

(52) U.S. Cl.
CPC ..... *G03G 15/2046* (2013.01); *G03G 15/2042* (2013.01)
USPC ..... 399/67; 399/334

(58) Field of Classification Search
CPC ..... G03G 15/2039; G03G 15/2042; G03G 15/2078; G03G 15/205; G03G 15/2053; G03G 2215/2035; G03G 15/2046; G03G 15/2064; G03G 15/2032; G03G 15/2067; G03G 15/2017; G03G 15/2025; G03G 15/2085; G03G 15/5029; G03G 15/20
USPC ..... 399/67, 334; 219/600
See application file for complete search history.

(56) References Cited

U.S. PATENT DOCUMENTS

| | | | |
|---|---|---|---|
| 2009/0148205 | A1 | 6/2009 | Seo et al. |
| 2009/0297197 | A1 | 12/2009 | Hase |
| 2010/0061753 | A1 | 3/2010 | Hase |

FOREIGN PATENT DOCUMENTS

| | | | |
|---|---|---|---|
| JP | 2008-040176 | A | 2/2008 |
| JP | 2008-139463 | A | 6/2008 |
| JP | 2008-139475 | A | 6/2008 |
| JP | 2009-145421 | A | 7/2009 |
| JP | 2009-271154 | A | 11/2009 |
| JP | 2009-271156 | A | 11/2009 |
| JP | 2009-288725 | A | 12/2009 |
| JP | 2010-066347 | A | 3/2010 |
| JP | 2010-197947 | A | 9/2010 |

OTHER PUBLICATIONS

Office Action (Decision to Grant a Patent) issued on Apr. 1, 2014, by the Japan Patent Office in corresponding Japanese Patent Application No. 2011-265087, and an English Translation of the Office Action (4 pages).

*Primary Examiner* — Walter L Lindsay, Jr.
*Assistant Examiner* — Ruth Labombard
(74) *Attorney, Agent, or Firm* — Buchanan Ingersoll & Rooney P.C.

(57) ABSTRACT

Provided is a fixing device comprising: a fixing rotating body; a magnetizing coil; a pressing member forming a fixing nip through which a recording sheet passes; a demagnetizing coil unit set including a pile of demagnetizing coil units each including demagnetizing coils of different sizes, and canceling out part of magnetic flux generated by the magnetizing coil in a non-sheet-passing region; a sheet information acquisition unit acquiring sheet information including information relating to a width of the recording sheet; and an operation control unit controlling each demagnetizing coil according to the width, wherein in each demagnetizing coil unit, the demagnetizing coils are arranged such that a smaller demagnetizing coil is surrounded by a larger demagnetizing coil and the demagnetizing coils are in a same plane extending along a surface of the magnetizing coil, and a combination of sizes of the demagnetizing coils differs among the demagnetizing coil units.

8 Claims, 11 Drawing Sheets

FIG. 8

| | | Main demagnetizing coil unit | | | Sub-demagnetizing coil unit | | |
|---|---|---|---|---|---|---|---|
| Sheet width | Example | First demagnetizing coil | Second demagnetizing coil | Third demagnetizing coil | First demagnetizing coil | Second demagnetizing coil | Third demagnetizing coil |
| W1 | A6 lengthwise | ON | OFF | OFF | ON | OFF | OFF |
| W2 | A5 lengthwise | ON | OFF | OFF | OFF | OFF | OFF |
| W3 | B5 lengthwise | OFF | ON | OFF | OFF | ON | OFF |
| W4 | A4 lengthwise | OFF | ON | OFF | OFF | OFF | OFF |
| W5 | B4 lengthwise | OFF | OFF | ON | OFF | OFF | ON |
| W6 | A3 lengthwise | OFF | OFF | ON | OFF | OFF | OFF |
| Smaller than W1 | Postcard lengthwise | ON | OFF | OFF | ON | OFF | OFF |
| Larger than W1 and smaller than W2 | B6 lengthwise | ON | OFF | OFF | (ON) | OFF | OFF |
| Larger than W2 and smaller than W3 | 2L crosswise | (ON) | ON | OFF | OFF | ON | OFF |
| Larger than W3 and smaller than W4 | Double postcard crosswise | OFF | ON | OFF | OFF | (ON) | OFF |
| Larger than W4 and smaller than W5 | Letter lengthwise | OFF | (ON) | ON | OFF | OFF | ON |
| Larger than W5 and smaller than W6 | Letter crosswise | OFF | OFF | ON | OFF | OFF | (ON) |

(ON) indicates that demagnetizing coil is appropriately switched on or off

FIXING DEVICE AND IMAGE FORMING DEVICE

This application is based on application No. 2011-265087 filed in Japan, the content of which is hereby incorporated by reference.

BACKGROUND OF THE INVENTION (1) Field of the Invention

The present invention relates to a fixing device and an image forming device, and in particular to an electromagnetic induction heating-type fixing device and an image forming device using the same.

(2) Description of Related Art

With the growing demand for energy conservation in the field of image forming devices in recent years, an electromagnetic induction heating-type fixing device having high energy efficiency is attracting attention.

The electromagnetic induction heating-type fixing device includes a fixing rotating body such as a fixing roller and a fixing belt, a magnetizing coil, and a demagnetizing coil. The magnetizing coil is disposed along an axial direction of the fixing rotating body, and generates an alternating field by passage of alternating current to heat the fixing rotating body by induction. The fixing rotating body heated by induction thermally fixes a toner image formed on a passing recording sheet.

The demagnetizing coil is disposed in a non-sheet-passing region of the fixing rotating body through which the recording sheet does not pass, and includes winding wire whose ends are connected together to form a closed loop. With this configuration, the demagnetizing coil generates magnetic flux in such a direction that part of magnetic flux generated by the magnetizing coil and trying to pass the demagnetizing coil is canceled out, thereby suppressing an increase in temperature in the non-sheet-passing region of the fixing rotating body. As a result, thermal degradation of the fixing rotating body and other peripheral members is prevented.

The following patent literatures disclose technology to suppress an increase in temperature in the non-sheet-passing region, in a case where recording sheets of different sizes are used. In such a case, the demagnetizing coil as described above is provided in a plurality so that demagnetization is performed according to a size of the non-sheet-passing region determined when each of the recording sheets passes therethrough.

For example, Japanese Patent Application Publication No. 2009-145421 discloses a fixing device having a structure in which a plurality of demagnetizing coils of different sizes are piled on a magnetizing coil such that a smaller demagnetizing coil is placed on a larger demagnetizing coil (first prior art).

Japanese Patent Application Publication No. 2010-197947 discloses a fixing device having a structure in which a plurality of demagnetizing coils of different sizes are arranged such that a smaller demagnetizing coil is surrounded by a larger demagnetizing coil and that the demagnetizing coils are in a same plane extending along a surface of a magnetizing coil (second prior art). The second prior art differs from the first prior art in that the demagnetizing coils of different sizes are arranged along the surface of the magnetizing coil so as to extend laterally, rather than to be piled on the magnetizing coil.

In the conventional fixing device described above, however, when more demagnetizing coils corresponding to recording sheets of a wider variety of sizes are provided, the following problems arise.

In the fixing device pertaining to the first prior art, since a pile of the demagnetizing coils is placed on the magnetizing coil, the device becomes large in a radial direction of the fixing rotating body. In addition, as the number of piled demagnetizing coils increases, the distance between an upper demagnetizing coil and the magnetizing coil increases and thus demagnetization efficiency is reduced accordingly. Therefore, when a large number of recording sheets corresponding to the upper demagnetizing coil pass and toner images are thermally fixed thereon continuously, over-temperature in the non-sheet-passing region cannot be completely suppressed and thus thermal degradation of the fixing rotating body can occur.

In the fixing device pertaining to the second prior art, since the number of surrounding demagnetizing coils is increased, the width of an outermost demagnetizing coil increases in a circumferential direction of the fixing rotating body and thus the device becomes large accordingly.

SUMMARY OF THE INVENTION

The present invention aims to provide a fixing device that does not become large and effectively suppresses over-temperature in the non-sheet-passing region compared to the conventional fixing device when more demagnetizing coils corresponding to recording sheets of a wider variety of sizes are provided, and an image forming device using the same.

In order to achieve the above-presented aim, a fixing device pertaining to one aspect of the present invention is a fixing device comprising: a fixing rotating body; a magnetizing coil disposed along a direction of a rotational axis of the fixing rotating body, and configured to heat the fixing rotating body by induction; a pressing member pressing against an outer circumferential surface of the fixing rotating body to form a fixing nip through which a recording sheet with an unfixed image formed thereon passes; a demagnetizing coil unit set including a pile of two or more demagnetizing coil units, each demagnetizing coil unit including a plurality of demagnetizing coils of different sizes, and being configured to cancel out part of magnetic flux generated by the magnetizing coil in a region corresponding to a non-sheet-passing region of the fixing rotating body; a sheet information acquisition unit configured to acquire sheet information including information relating to a width of the recording sheet; and an operation control unit configured to control an operation of each of the demagnetizing coils according to the width of the recording sheet, wherein in each demagnetizing coil unit, the demagnetizing coils are arranged such that a smaller demagnetizing coil is surrounded by a larger demagnetizing coil and that the demagnetizing coils are in a same plane extending along a surface of the magnetizing coil, and a combination of sizes of the demagnetizing coils differs among the demagnetizing coil units.

The "same plane" here is not limited to a flat plane as long as it extends along the surface of the magnetizing coil, and may be curved when the surface of the magnetizing coil is curved.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 4 is a perspective view showing positional relationships among a magnetizing coil, main demagnetizing coil units, sub-demagnetizing coil units, and the like;

FIG. 8 is a table showing relationships between the width of a passing sheet and an operation of each demagnetizing coil;

DESCRIPTION OF PREFERRED EMBODIMENTS

First Embodiment

The following describes a first embodiment of an image forming device pertaining to the present invention by taking a tandem-type color printer (hereinafter, simply referred to as a "printer") as an example, with reference to the drawings.

<Overall Configuration of Printer>

Figure 1:
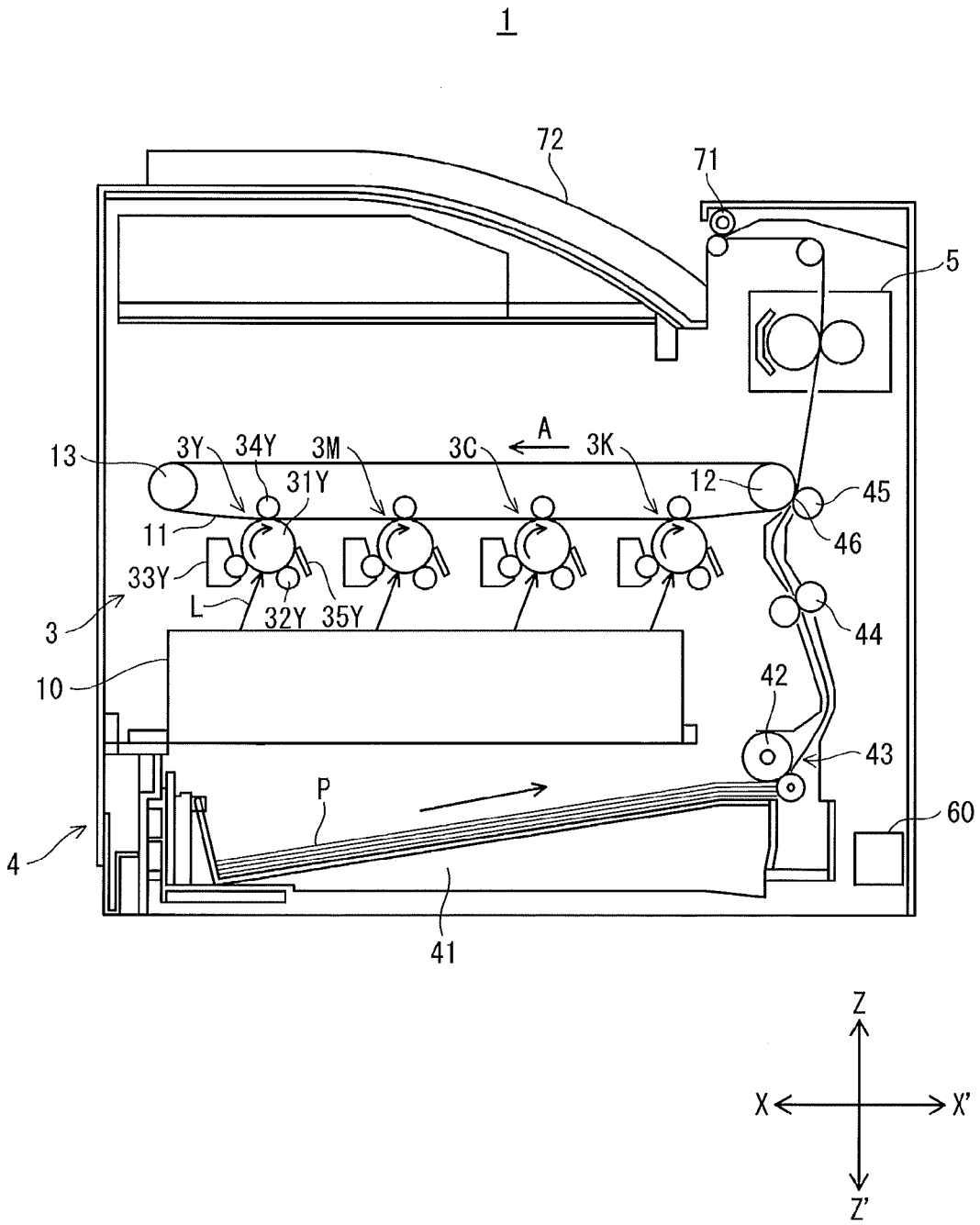
FIG. 1 is a schematic view showing a configuration of a printer pertaining to an embodiment of the present invention.

FIG. 1 is a schematic view showing a configuration of a printer 1 pertaining to the present embodiment.

As shown in FIG. 1, the printer 1 includes an image process unit 3, a paper feed unit 4, a fixing unit 5, and a control unit 60. The printer 1 is connected to a network (e.g. LAN). Upon receiving an instruction to execute a print job from an external terminal device (not illustrated), the printer 1 forms toner images of respective colors including yellow, magenta, cyan, and black based on the received instruction, forms a color image by multi-transferring the toner images, and then performs a printing operation on a recording sheet.

Hereinafter, reproduction colors of yellow, magenta, cyan, and black are respectively represented by Y, M, C, and K. Y, M, C, and K are added to reference signs of components relating to respective reproduction colors.

The image process unit 3 includes imaging units 3Y, 3M, 3C, and 3K respectively corresponding to Y, M, C, and K colors, an optical unit 10, and an intermediate transfer belt 11.

The imaging unit 3Y includes a photoreceptor drum 31Y, and a charger 32Y, a developing unit 33Y, a primary transfer roller 34Y, and a cleaner 35Y for cleaning the photoreceptor drum 31Y that are disposed around the photoreceptor drum 31Y. The imaging unit 3Y forms a toner image of Y color on the photoreceptor drum 31Y. The other imaging units 3M, 3C, and 3K are similar to the imaging unit 3Y in configuration, and reference signs of components included in the other imaging units 3M, 3C, and 3K are omitted in FIG. 1.

The intermediate transfer belt 11 is an endless belt that is bridged in a tensioned state between a driving roller 12 and a driven roller 13, and runs in circle in a direction of an arrow A.

The optical unit 10 includes a light-emitting element such as a laser diode. The optical unit 10 emits laser light L for forming images of Y, M, C, and K colors by a drive signal transmitted from the control unit 60, and performs exposure scanning on the photoreceptor drums 31Y, 31M, 31C, and 31K.

By the exposure scanning, electrostatic latent images are formed on the respective photoreceptor drums 31Y, 31M, 31C, and 31K respectively charged by the chargers 32Y 32M, 32C, and 32K. The electrostatic latent images are developed by the respective developing units 33Y, 33M, 33C, and 33K, so that toner images of Y, M, C, and K colors are respectively formed on the photoreceptor drums 31Y, 31M, 31C, and 31K.

The formed toner images are primary-transferred on the intermediate transfer belt 11 by electrostatic forces developed by applying voltages to the primary transfer rollers 34Y, 34M, 34C, and 34K. At the time of primary transfer, imaging operations of the imaging units 3Y, 3M, 3C, and 3K are performed at different timings so that a toner image formed on an upstream photoreceptor drum is transferred earlier than a toner image formed on a downstream photoreceptor drum in a direction in which the intermediate transfer belt 11 runs. As a result, the toner images of respective colors are transferred onto the same position on the running intermediate transfer belt 11 in layers to form a full-color toner image.

The paper feed unit 4 includes a paper feed cassette 41 for storing therein one or more recording sheets P, a pick-up roller 42 that picks up the recording sheets P stored in the paper feed cassette 41 to a conveyance path 43 one at a time, and a timing roller pair 44 that measures a timing at which the picked-up recording sheet P is conveyed to a secondary transfer position 46.

The full-color toner image formed on the intermediate transfer belt 11 is secondary-transferred onto a recording sheet P fed by the paper feed unit 4 by an electrostatic force developed by applying a voltage to a secondary transfer roller 45 at the secondary transfer position 46.

The recording sheet P with the full-color toner image (an unfixed image) formed thereon by the above-mentioned secondary transfer is conveyed to the fixing unit 5. The fixing unit 5 thermally fixes the full-color toner image formed on the recording sheet P by applying heat and pressure. The recording sheet P is then ejected by an ejection roller pair 71 onto an ejection tray 72.

The control unit 60 controls operations of the image process unit 3, the paper feed unit 4, and the fixing unit 5 described above.

<Configuration of Fixing Unit>

The following describes a configuration of the fixing unit 5.

Figure 2:
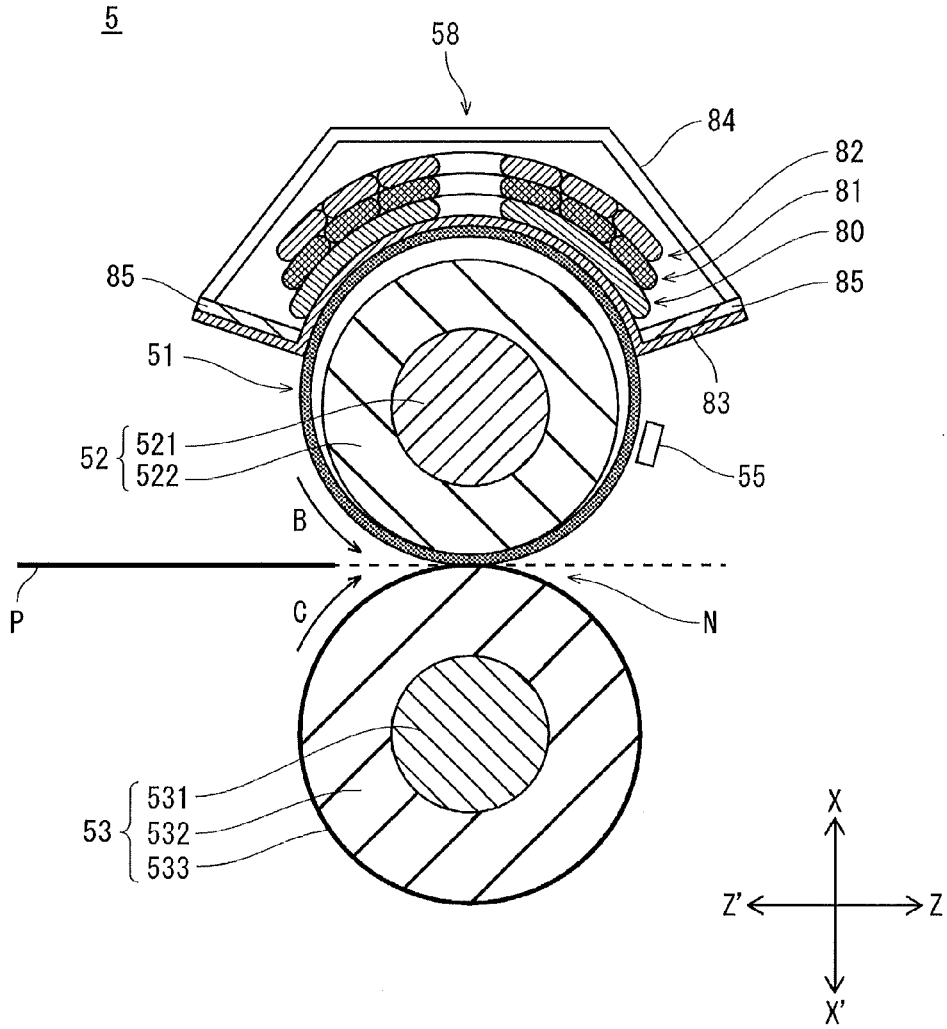
FIG. 2 is a sectional view showing a configuration of main components of a fixing unit included in the printer.

FIG. 2 is a sectional view showing a configuration of main components of the fixing unit 5.

The fixing unit 5 is an electromagnetic induction heating-type fixing unit, and includes a fixing belt 51 as a fixing rotating body, a fixing roller 52, a pressing roller 53, temperature sensors 54 and 55 (see FIG. 5), and a magnetic flux generation unit 58.

The fixing roller 52 is inserted into the fixing belt 51 with clearance so as to be parallel to the pressing roller 53. The pressing roller 53 presses against the fixing roller 52 by being pressed by a pressing mechanism (not illustrated) via the fixing belt 51. With this configuration, a fixing nip N through which the recording sheet P passes is formed between the fixing belt 51 and the pressing roller 53.

The pressing roller 53 is driven, by a motor (not illustrated), to rotate via a power transmission mechanism such as a gear and a belt. Following the rotation of the pressing roller 53, the fixing belt 51 and the fixing roller 52 are driven to rotate in conjunction with each other. The pressing roller 53 rotates in a direction of an arrow C, and the fixing belt 51 and the fixing roller 52 each rotate in a direction of an arrow B.

The following describes individual components of the fixing unit 5 in detail.

(Fixing Belt, Fixing Roller, Pressing Roller)

Figure 3:
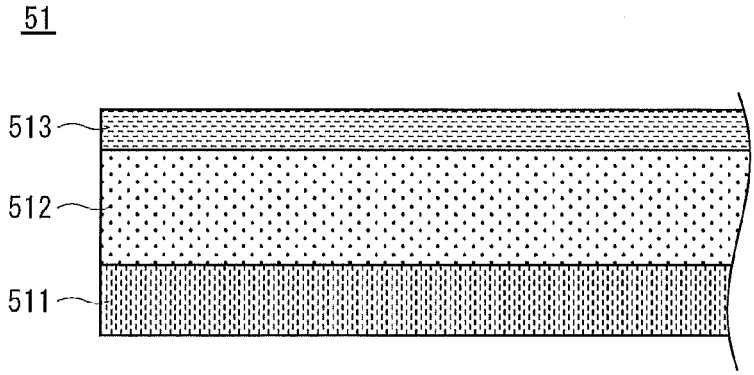
FIG. 3 is a local sectional view of a fixing belt.

As shown in a local sectional view of FIG. 3, the fixing belt 51 includes a metal heat generation layer 511 as an inner circumference thereof (shown at lower part of the figure), an elastic layer 512, and a release layer 513 arranged in this order. The metal heat generation layer 511 is formed of a magnetic material such as Ni, SUS, and Fe. The elastic layer 512 is formed of a rubber material, a resin material, and the like having heat resistance, resilience, and insulating properties, such as a silicone rubber. The release layer 513 is a layer for enhancing release properties from the recording sheet P after fixing, and is formed of an insulating resin having heat resistance and high release properties. As the insulating resin, a fluororesin such as PFA (tetrafluoroethylene perfluoroalkoxyethylene copolymer) is usable.

The width of the fixing belt 51 is set to be larger than a maximum sheet-passing width, which is a maximum width of a region on the fixing belt 51 through which a recording sheet P passes (e.g. A3 lengthwise).

Referring back to FIG. 2, the fixing roller 52 includes an elongated cylindrical cored bar 521 and a heat insulating layer 522 formed around the cored bar 521. The cored bar 521 is formed of a nonmagnetic material such as aluminum, and the heat insulating layer 522 is formed of elastomeric foam having high heat resistance and high heat insulating properties, such as a silicone rubber and a fluororubber.

The pressing roller 53 includes an elongated cylindrical cored bar 531, and an elastic layer 532 and a release layer 533 formed around the cored bar 531 in this order. The cored bar 521, the elastic layer 532, and the release layer 533 are respectively formed, for example, of aluminum, a silicone rubber, and a fluorine-based resin such as PFA.

In the present embodiment, the length of the fixing roller 52 and the length of the pressing roller 53 are each approximately equal to the width of the fixing belt 51.

(Magnetic Flux Generation Unit)

The magnetic flux generation unit 58 includes a magnetizing coil 80, a main demagnetizing coil unit 81, a sub-demagnetizing coil unit 82, a coil bobbin 83, a main core 84, and sub-cores 85.

The coil bobbin 83 is disposed along a width direction of an outer circumferential surface of the fixing belt 51 to hold the magnetizing coil 80, the main demagnetizing coil unit 81, the sub-demagnetizing coil unit 82, the main core 84, and the sub-cores 85.

A cross section of a part of the coil bobbin 83 that faces the outer circumferential surface of the fixing belt 51 is curved in an arc along the outer circumferential surface of the fixing belt 51. The coil bobbin 83 is fixed by a frame not shown in the figures so that the gap between the arc-shaped surface and the fixing belt 51 is a predetermined distance, for example, approximately 1.5 mm.

The main core 84 and the sub-cores 85 are each formed of a highly magnetic low-loss material such as an alloy including ferrite and permalloy.

The main core 84 is formed of a material trapezoidally flexed so as to cover an outer surface of the magnetizing coil 80. Both ends of the main core 84 are attached to the sub-cores 85. The main core 84 is provided in a plurality in a width direction of the fixing belt 51 at predetermined intervals, although they are not illustrated.

The sub-cores 85 are each elongated in the width direction of the fixing belt 51 so as to be parallel to the fixing belt 51, and adhered to the coil bobbin 83, for example, by a silicone adhesive.

The main core 84 and the sub-cores 85 prevent magnetic flux generated by the magnetizing coil 80 from leaking to a side opposite the fixing belt 51, so that the fixing belt 51 is effectively heated by induction.

Figure 4:
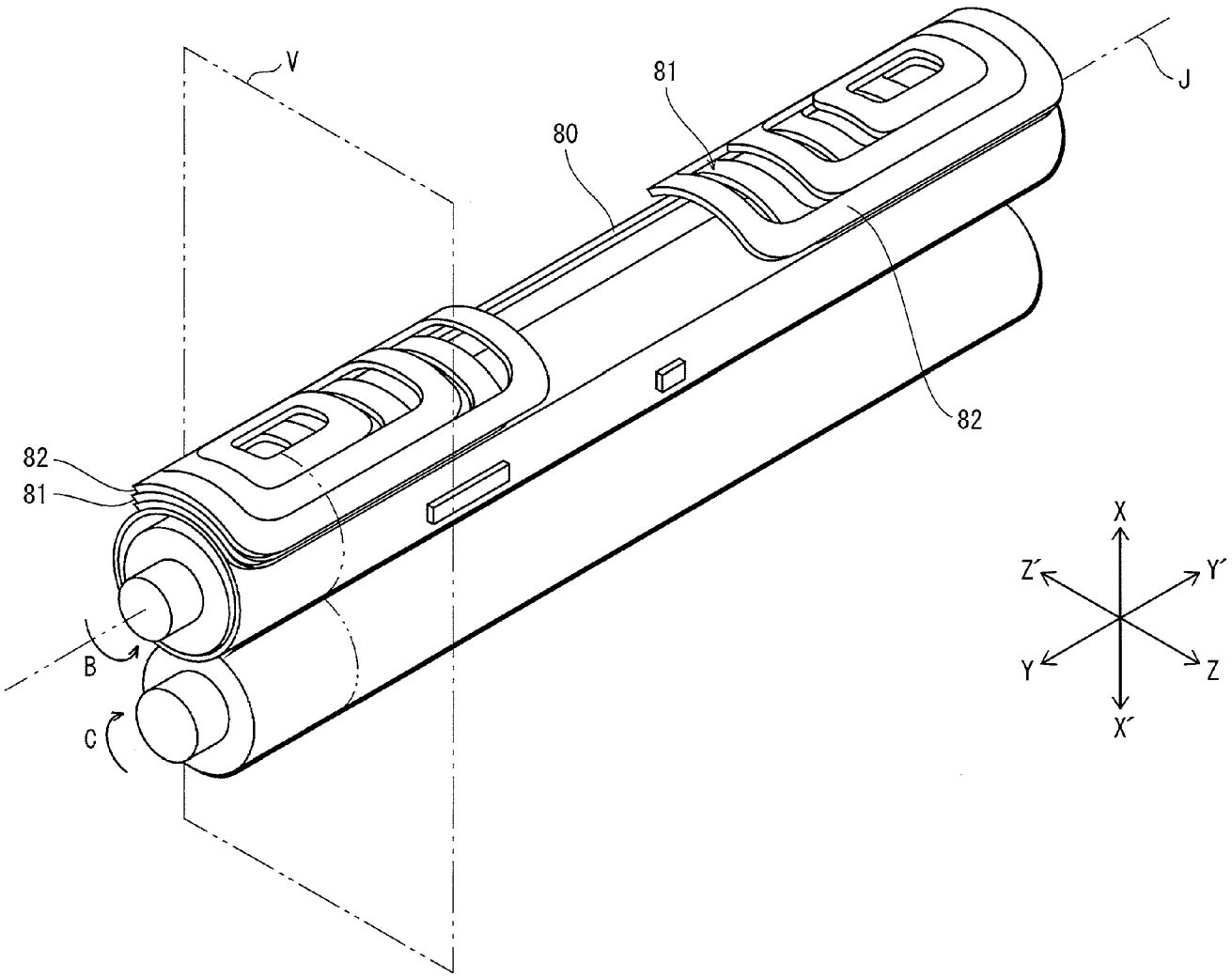

FIG. 4 is a perspective view showing positional relationships among the magnetizing coil 80, the main demagnetizing coil units 81, the sub-demagnetizing coil units 82, and the like.

As shown in FIG. 4, the magnetizing coil 80 is formed by winding litz wire along a circumferential surface of the fixing belt 51 in a direction of an imaginary axis J of rotation of the fixing belt 51 (hereinafter, the imaginary axis J is referred to as a "rotational axis J", and, as for each coil, a direction along the rotational axis J is simply referred to as a "longitudinal direction"). In each of non-sheet-passing regions at both ends of the fixing belt 51 in a longitudinal direction, a pile of the main demagnetizing coil unit 81 and the sub-demagnetizing coil unit 82 is placed on the magnetizing coil 80.

A longitudinal size of the magnetizing coil 80 is set to be larger than the maximum sheet-passing width (in the present embodiment, the width of the recording sheet P in a case where an A3-sized recording sheet is conveyed so that a longer side thereof is parallel to a sheet conveyance direction (A3 lengthwise). The magnetizing coil 80 generates alternating magnetic flux to heat the metal heat generation layer 511 of the fixing belt 51 upon receiving high-frequency power supply.

Referring back to FIG. 2, the magnetizing coil 80 is formed along a surface of the coil bobbin 83 that is curved in an arc in cross section, and is adhered to the coil bobbin 83, for example, by a heat-resistant adhesive. With this configuration, the magnetizing coil 80 is formed along a circumferential direction of the fixing belt 51 in cross section.

FIG. 2 is a sectional view of the magnetizing coil 80 and the like, cut along an imaginary plane V shown in FIG. 4, when viewed from an Y' direction.

Figure 5:
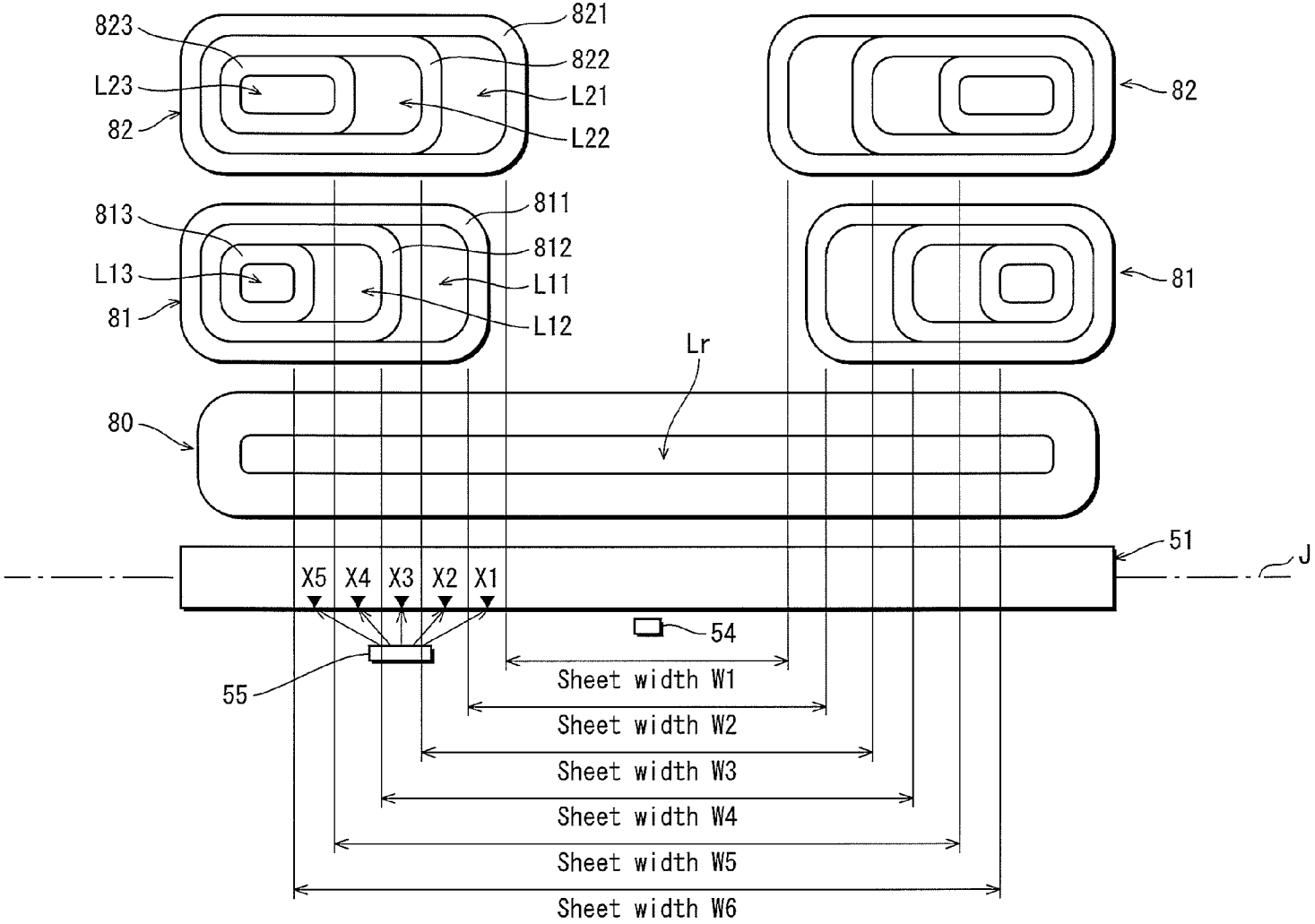
FIG. 5 is a plan view separately showing the magnetizing coil, the main demagnetizing coil units, and the sub-demagnetizing coil units shown in FIG. 4.

FIG. 5 shows positional relationships among the magnetizing coil 80, demagnetizing coils included in each of the main demagnetizing coil units 81, and demagnetizing coils included in each of the sub-demagnetizing coil units 82 shown in FIG. 4 in a direction along the rotational axis J. For convenience's sake, the main demagnetizing coil units 81 and the sub-demagnetizing coil units 82 are shown in parallel with each other (the same applies to FIG. 7).

As shown in FIG. 5, each of the main demagnetizing coil units 81 is composed of three demagnetizing coils of different sizes, i.e. a first demagnetizing coil 811, a second demagnetizing coil 812, and a third demagnetizing coil 813, arranged such that the third demagnetizing coil 813, which is the smallest demagnetizing coil, is surrounded by the second demagnetizing coil 812, and the second demagnetizing coil 812 is further surrounded by the first demagnetizing coil 811, which is the largest demagnetizing coil.

The third demagnetizing coil 813 and the second demagnetizing coil 812 are arranged close to an end of the fixing belt 51 in a direction of the rotational axis J within a loop L12 of the second demagnetizing coil 812 and a loop L11 of the first demagnetizing coil 811, respectively.

Each of the first demagnetizing coil 811, the second demagnetizing coil 812, and the third demagnetizing coil 813 is formed by winding litz wire such that these demagnetizing coils are in a same plane extending along a top surface of the magnetizing coil 80 and have approximately the same thickness. Each of the demagnetizing coils is curved in an arc in cross section. The same plane is a reference plane for windings of these demagnetizing coils each having a plate-like shape.

Both ends of litz wire forming each of the first demagnetizing coil 811, the second demagnetizing coil 812, and the third demagnetizing coil 813 are connected together to form a closed loop, and thus magnetic flux is generated in such a direction that part of magnetic flux generated by the magnetizing coil 80 and trying to pass the loops L11, L12, and L13 is canceled out. Respective regions within the loops L11, L12, and L13 can therefore be referred to as demagnetization regions. The regions within the loops L11, L12, and L13 are hereinafter referred to as demagnetization regions L11, L12, and L13, respectively.

A longitudinal size of the demagnetization region L11 of the first demagnetizing coil 811 corresponds to the length of the non-sheet-passing region of the fixing belt 51 in a direction along the rotational axis J when a recording sheet having a sheet width W2 passes (e.g. A5 lengthwise).

Hereinafter, the above-mentioned sentence is simply referred to as "the demagnetization region L11 corresponds to the non-sheet-passing region of the sheet width W2". The same applies to the other demagnetization regions. The sheet width in the present embodiment refers to the width of a recording sheet in a direction perpendicular to a direction in which the recording sheet passes. Hereinafter, a region of the magnetizing coil 80 corresponding to the non-sheet-passing region of the fixing belt 51 is simply referred to as a "non-sheet-passing region of the magnetizing coil 80".

The demagnetization region L12 of the second demagnetizing coil 812 corresponds to the non-sheet-passing region of a sheet width W4 (e.g. A4 lengthwise). The demagnetization region L13 of the third demagnetizing coil 813 corresponds to the non-sheet-passing region of a sheet width W6 (e.g. A3 lengthwise).

The basic configuration of the sub-demagnetizing coil unit 82 is similar to that of the main demagnetizing coil unit 81. The sub-demagnetizing coil unit 82 is composed of three demagnetizing coils of different longitudinal sizes, i.e. a first demagnetizing coil 821, a second demagnetizing coil 822, and a third demagnetizing coil 823, arranged such that a smaller demagnetizing coil is surrounded by a larger demagnetizing coil and that these demagnetizing coils are in a same plane extending along a surface of the magnetizing coil 80.

Relationships among (longitudinal) sizes of the first demagnetizing coil 821, the second demagnetizing coil 822, and the third demagnetizing coil 823 included in the sub-demagnetizing coil unit 82 and the first demagnetizing coil 811, the second demagnetizing coil 812, and the third demagnetizing coil 813 included in the main demagnetizing coil unit 81 are as follows: the first demagnetizing coil 821 included in the sub-demagnetizing coil unit 82 is the largest coil, and the first demagnetizing coil 811 included in the main demagnetizing coil unit 81 is the second largest coil, followed by the second demagnetizing coil 822 included in the sub-demagnetizing coil unit 82, the second demagnetizing coil 812 included in the main demagnetizing coil unit 81, the third demagnetizing coil 823 included in the sub-demagnetizing coil unit 82, and the third demagnetizing coil 813 included in the main demagnetizing coil 81 in order of size. As described above, the demagnetizing coils are arranged so that the size of each demagnetizing coil decreases alternately between the sub-demagnetizing coil unit 82 and the main demagnetizing coil unit 81.

The demagnetization region L21 of the first demagnetizing coil 821, the demagnetization region L22 of the second demagnetizing coil 822, and the demagnetization region L23 of the third demagnetizing coil 823 respectively correspond to the non-sheet-passing region of a sheet width W1 (e.g. A6 lengthwise), the non-sheet-passing region of a sheet width W3 (e.g. B5 lengthwise), and the non-sheet-passing region of a sheet width W5 (e.g. B4 lengthwise).

The main demagnetizing coil unit 81 is adhered to the magnetizing coil 80 by a heat-resistant adhesive, and the sub-demagnetizing coil unit 82 is adhered to the main demagnetizing coil unit 81 by a heat-resistant adhesive.

According to the configuration of the fixing unit 5 described above, each of the main demagnetizing coil unit 81 and the sub-demagnetizing coil unit 82 is composed of three demagnetizing coils. Compared to the fixing devices pertaining to the above-mentioned first prior art and second prior art each including the same number, i.e. six, of demagnetizing coils as the fixing unit 5, the device is prevented from becoming large. Specifically, in the fixing device pertaining to the first prior art, six demagnetizing coils are simply placed on top of each other to form a pile of six demagnetizing coils. On the other hand, in the fixing unit 5, the number of demagnetizing coils placed on top of each other (the number of piled demagnetizing coil units) is significantly reduced to two. In the fixing device pertaining to the second prior art, six demagnetizing coils included in one demagnetizing coil unit are arranged such that a smaller demagnetizing coil is surrounded by a larger demagnetizing coil. On the other hand, in the fixing device 5, only three demagnetizing coils are arranged such that a smaller demagnetizing coil is surrounded by a larger demagnetizing coil, and thus the width of the demagnetizing coil unit in a circumferential direction of the fixing belt is reduced.

Furthermore, in the fixing unit 5, there is no demagnetizing coil that is extremely remote from the magnetizing coil as a top demagnetizing coil (a demagnetizing coil at the sixth tier) in the fixing device pertaining to the first prior art. Therefore, predetermined demagnetization efficiency is ensured in each demagnetizing coil, and over-temperature in the non-sheet-passing region is suppressed compared to the conventional technology.

(Temperature Sensor)

The temperature sensor 54 includes, for example, a non-contact type thermistor, and is disposed approximately in the middle of the fixing belt 51 in the width direction thereof. The temperature sensor 54 detects surface temperature in a sheet-passing region of the fixing belt 51, and outputs the detection results to the control unit 60. The control unit 60 controls power supply to the magnetizing coil 80 based on the detection results of the temperature sensor 54 so that the surface temperature in the sheet-passing region of the fixing belt 51 becomes predetermined fixing temperature (e.g. 180° C.).

The temperature sensor 55 includes, for example, an infrared detection type thermopile array, and is disposed at one end portion of the fixing belt 51 in the width direction thereof. The temperature sensor 55 is designed so as to detect surface temperature of the fixing belt 51 at a plurality of locations (in the present embodiment, at locations X1, X2, X3, X4, and X5 shown in FIG. 5), and outputs the detection results to the control unit 60.

The locations X1, X2, X3, X4, and X5 are locations within the non-sheet-passing region of the fixing belt 51 and near the sheet-passing region of the fixing belt 51 when the recording sheets P having sheet widths W1, W2, W3, W4, and W5 pass, respectively. The control unit 60 controls operations of the main demagnetizing coil unit 81 and the sub-demagnetizing coil unit 82 based on the detection results of the temperature sensor 55 so as not to cause the over-temperature in the non-sheet-passing region of the fixing belt 51. Details of the control are described later.

The temperature sensors 54 and 55 are each held by a frame (not illustrated) so as to be a predetermined distance away from a surface of the fixing belt 51.

<Magnetizing Circuit and Demagnetizing Circuit>

Figure 6:
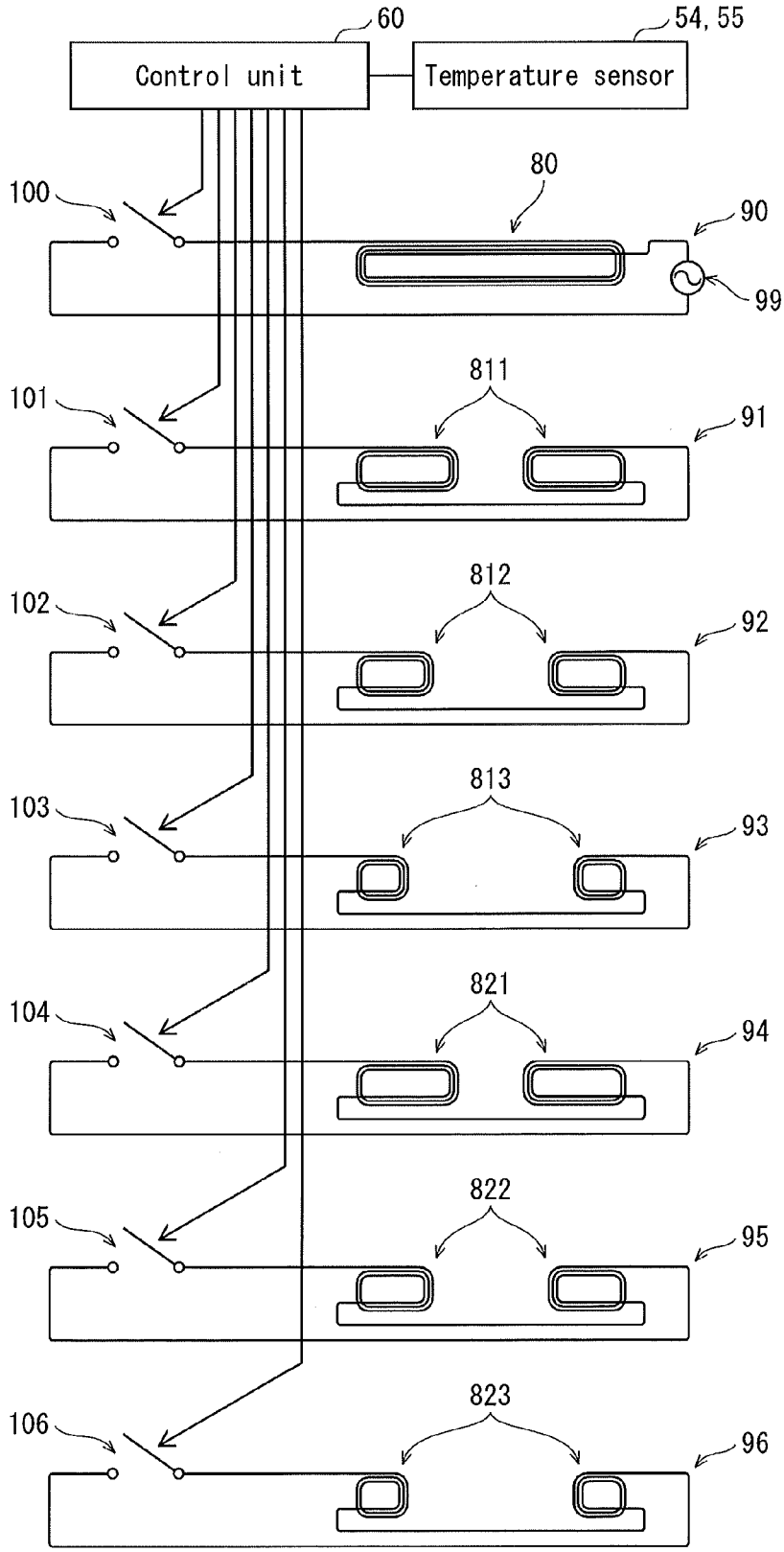
FIG. 6 shows a configuration example of a magnetizing circuit and demagnetizing circuits.

FIG. 6 shows a configuration example of a magnetizing circuit 90 for driving the magnetizing coil and demagnetizing circuits 91 to 96 for driving the respective demagnetizing coils.

As shown in FIG. 6, the magnetizing circuit 90 is formed by connecting the magnetizing coil 80, a high-frequency power source 99, and a switching relay 100 in series. The high-frequency power source 99 outputs high-frequency power (of 10 kHz to 100 kHz, and 100 W to 2000 W, for example) to be supplied to the magnetizing coil 80. The switching relay 100 includes a well-known relay switch, and switches on or off the power supply by being controlled by the control unit 60.

The demagnetizing circuits 91, 92, and 93 respectively drive the first demagnetizing coil 811, the second demagnetizing coil 812, and the third demagnetizing coil 813 included in the main demagnetizing coil unit 81. The demagnetizing circuits 94, 95, and 96 respectively drive the first demagnetizing coil 821, the second demagnetizing coil 822, and the third demagnetizing coil 823 included in the sub-demagnetizing coil unit 82.

The demagnetizing circuit 91 is formed by connecting the first demagnetizing coils 811 and a switching relay 101 in series. The switching relay 101 switches on or off operations of the first demagnetizing coils 811 by being controlled by the control unit 60. When the switching relay 101 is switched on to close the demagnetizing circuit 91, a magnetic field is generated in the first demagnetizing coils 811 in such a direction that part of alternating magnetic flux generated by the magnetizing coil 80 is canceled out. In contrast, when the switching relay 101 is switched off to open the demagnetizing circuit 91, the first demagnetizing coils 811 do not operate and thus effects of demagnetizing part of the alternating magnetic flux generated by the magnetizing coil 80 are not produced.

Similarly, the demagnetizing circuit 92 is composed of the second demagnetizing coils 812 and a switching relay 102, and the demagnetizing circuit 93 is composed of the third demagnetizing coils 813 and a switching relay 103. Also, the demagnetizing circuit 94 is composed of the first demagnetizing coils 821 and a switching relay 104, the demagnetizing circuit 95 is composed of the second demagnetizing coils 822 and a switching relay 105, and the demagnetizing circuit 96 is composed of the third demagnetizing coils 823 and a switching relay 106.

The control unit 60 controls an operation of the magnetizing coil 80 based on the detection results of the temperature sensor 54 by transmitting a control signal to the switching relay 100 so that the surface temperature in the sheet-passing region of the fixing belt 51 becomes the fixing temperature. Upon receiving a print job from an external terminal, the control unit 60 extracts information relating to a sheet size designated by a user from header information of the received print job, performs control based on the extracted information so that the recording sheet P of the designated size is fed during image formation, and transmits a drive signal to the switching relays 101 to 106 to control operations of the demagnetizing coils 811 to 813, and 821 to 823.

When the recording sheet P stored in the paper feed cassette 41 is not the recording sheet P of the designated size, the control unit 60 returns error information to the external terminal having transmitted the print job. When the recording sheet P of the designated size is set in the paper feed cassette 41, the control unit 60 performs control so that the recording sheet P is fed, and transmits a drive signal to the switching relays 101, 102, 103, 104, 105, and 106 to control operations of the demagnetizing coils 811, 812, 813, 821, 822, and 823, respectively. A size of the recording sheet P stored in the paper feed cassette 41 is detected by a well-known size detection sensor, or input by a user via an operation panel when the recording sheet P is set to the paper feed cassette.

<Control over Operation of Demagnetizing Coil>

FIGS. 7A to 7D show examples of control over an operation of each demagnetizing coil. FIG. 8 is a table showing relationships between the width of a passing sheet and the operation of each demagnetizing coil.

For simplicity's sake, in each of FIGS. 7A to 7D, the sub-demagnetizing coil units 82 are shifted in a vertical scanning direction (recording sheet conveyance direction) relative to the main demagnetizing coil units 81 so that the sub-demagnetizing coil units 82 and the main demagnetizing coil units 81 do not overlap each other. In addition, in each of FIGS. 7A to 7D, demagnetizing coils normally operating during a fixing operation are blackened.

Figure 7B:
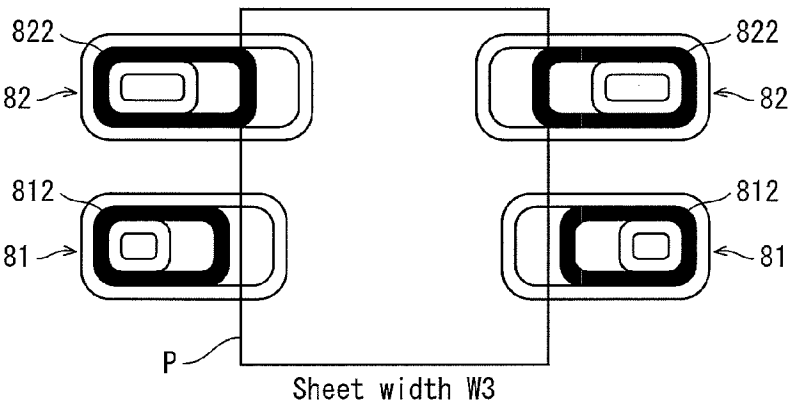
FIG. 7B shows an example of the control when the sub-demagnetizing coil unit includes the demagnetizing coil having the demagnetization region whose longitudinal size is approximately equal to the size of the non-sheet-passing region.
Figure 7A:
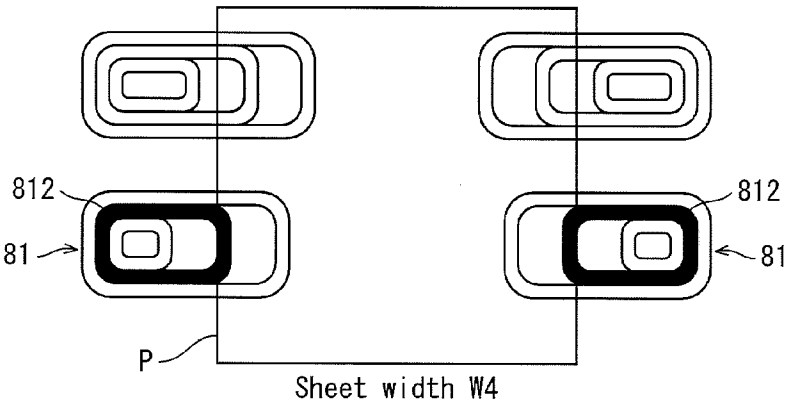
FIG. 7A shows an example of control over an operation of each demagnetizing coil when the main demagnetizing coil unit includes a demagnetizing coil having a demagnetization region whose longitudinal size is approximately equal to a size of a non-sheet-passing region.

FIG. 7A shows an example of the control when the main demagnetizing coil unit 81 includes a demagnetizing coil having a demagnetization region whose longitudinal size is approximately equal to a size of the non-sheet-passing region of a passing recording sheet.

For example, when the recording sheet P having the sheet width W4 passes, the control unit 60 switches on only an operation of the second demagnetizing coil 812 included in the main demagnetizing coil unit 81, which has a demagnetization region corresponding to the non-sheet-passing region of the sheet width W4 in longitudinal size. Hereinafter, comparison between a size of demagnetization region of a specific demagnetizing coil and a size of non-sheet-passing region is made based on sizes in the longitudinal direction (a direction along the rotational axis J).

Hereinafter, a demagnetizing coil uniquely determined as the demagnetizing coil having the demagnetization region corresponding to the non-sheet-passing region as described above is referred to a "specific coil" (as exemplary applications, see columns corresponding to the sheet widths W2, W4, and W6 in the table shown in FIG. 8).

FIG. 7B shows an example of the control when the sub-demagnetizing coil unit 82 includes the specific coil.

For example, when the recording sheet P having the sheet width W3 passes, the control unit 60 switches on an operation of the second demagnetizing coil 822 included in the sub-demagnetizing coil unit 82, which corresponds to the non-sheet-passing region of the sheet width W3 as the specific coil. The control unit 60 also switches on an operation of the second demagnetizing coil 812 included in the main demagnetizing coil unit 81, which is the largest demagnetizing coil of all the demagnetizing coils that are included in the main demagnetizing coil unit 81 and are smaller than the second demagnetizing coil 822 included in the sub-demagnetizing coil unit 82.

As described above, when the specific coil is included in the sub-demagnetizing coil unit 82, from among the demagnetizing coils included in the main demagnetizing coil unit 81, a demagnetizing coil that is the closest to the specific coil in size of all demagnetizing coils smaller than the specific coil is selected and normally operated.

The sub-demagnetizing coil unit 82 is placed above the magnetizing coil 80 via the main demagnetizing coil unit 81, and thus is a little farther away from the magnetizing coil 80 than the main demagnetizing coil unit 81 is. Therefore, the demagnetization efficiency of the sub-demagnetizing coil unit 82 is reduced accordingly. When a large number of sheets are printed continuously in a state where only the specific coil included in the sub-demagnetizing coil unit 82 is operated, over-temperature in the non-sheet-passing region of the fixing belt 51 cannot be completely suppressed in some cases. By selecting, from among the demagnetizing coils included in the main demagnetizing coil unit 81, the demagnetizing coil that is the closest to the specific coil in size of all the demagnetizing coils smaller than the specific coil and operating the selected demagnetizing coil along with the specific coil included in the sub-demagnetizing coil unit 82, demagnetization effects are complemented.

Hereinafter, a demagnetizing coil that is selected from among the demagnetizing coils included in the main demagnetizing coil unit 81 to complement the demagnetization effects of the specific coil included in the sub-demagnetizing coil unit 82 as described above is referred to a "complementary coil."

Since the complementary coil selected in the above-mentioned manner is smaller than the specific coil, and the closest to the specific coil in longitudinal size of all the demagnetizing coils included not only in the main demagnetizing coil unit 81 but also in the sub-demagnetizing coil unit 82, the selected complementary coil produces the greatest complementary effect, compared to a case where another demagnetizing coil is operated to complement the demagnetization effects (as exemplary applications, see columns corresponding to the sheet widths W1, W3, and W5 in the table shown in FIG. 8).

Figure 7D:
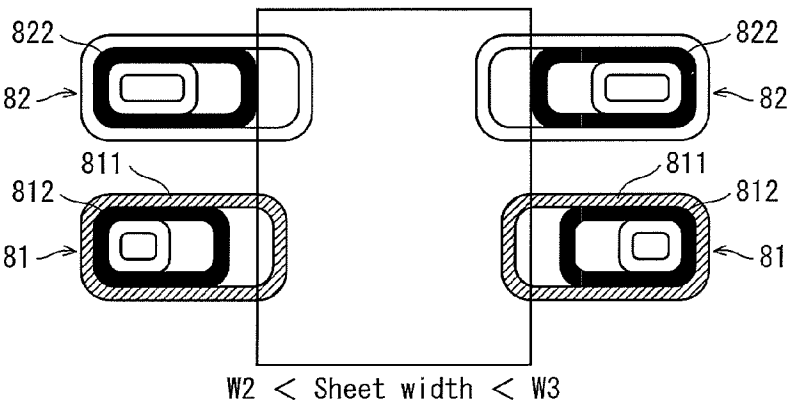
FIGS. 7C and 7D each show an example of the control when the demagnetizing coil having the demagnetization region whose longitudinal size is approximately equal to the size of the non-sheet-passing region is not included in either of the main demagnetizing coil unit or the sub-demagnetizing coil unit.
Figure 7C:
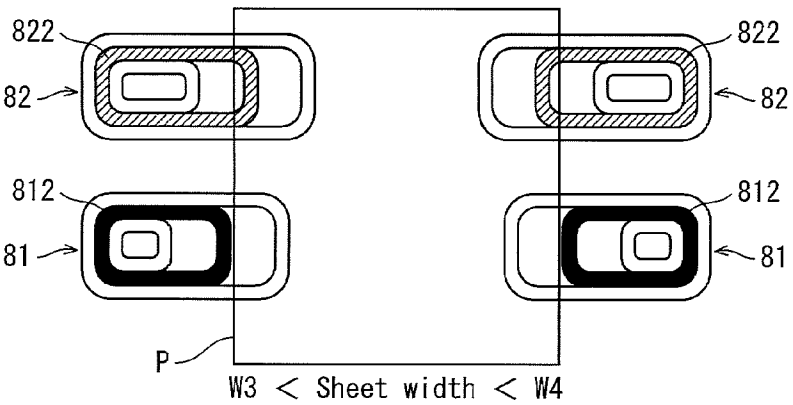

FIGS. 7C and 7D each show an example of the control when a demagnetizing coil having a demagnetization region approximately equal to a non-sheet-passing region of a passing recording sheet is not included in either of the main demagnetizing coil unit 81 or the sub-demagnetizing coil unit 82.

In this case, the largest demagnetizing coil of all the demagnetizing coils each having a demagnetization region smaller than the non-sheet-passing region is first determined as the specific coil corresponding to the non-sheet-passing region.

However, temperature in a part of the non-sheet-passing region that does not overlap the demagnetization region of the specific coil (a part of the non-sheet-passing region that is the closest to the sheet-passing region, hereinafter, referred to as a "non-demagnetization region") gradually rises with an increase in the number of sheets to be printed continuously. In order to suppress an excessive increase in the temperature in the non-demagnetization region, an operation of the smallest demagnetizing coil of all the demagnetizing coils each having a demagnetization region larger than the non-sheet-passing region (hereinafter, referred to as an "auxiliary coil") is appropriately switched on or off while monitoring the temperature in the non-demagnetization region. In each of FIGS. 7C and 7D, the auxiliary coil appropriately switched on or off is shown by hatching.

FIG. 7C shows an example of the control when the main demagnetizing coil unit 81 includes the specific coil described above.

For example, when the recording sheet P having a sheet width larger than W3 and smaller than W4 (e.g. a double postcard crosswise) passes, there is no demagnetizing coil having a demagnetization region approximately equal to the non-sheet-passing region of the passing recording sheet P. The control unit 60 therefore sets, as the specific coil, the second demagnetizing coil 812 included in the main demagnetizing coil unit 81, which is the largest demagnetizing coil of all the demagnetizing coils each having a demagnetization region smaller than the non-sheet-passing region of the sheet width W4. The control unit 60 also sets the second demagnetizing coil 822 included in the sub-demagnetizing coil unit 82 as the auxiliary coil.

The control unit 60 appropriately switches on or off the second demagnetizing coil 822 set as the auxiliary coil, while checking the temperature in the non-demagnetization region of the fixing belt 51 (in this embodiment, the temperature at the detection location X3 shown in FIG. 5).

As described above, the specific coil is continuously switched on (hereinafter, referred to as "basic control") and the auxiliary coil is appropriately switched on or off based on the temperature in a corresponding non-demagnetization region (hereinafter, referred to as "auxiliary control") during execution of a print job (during execution of a fixing operation). With this structure, over-temperature in the non-sheet-passing region of the fixing belt 51 is suppressed accurately even when there is no demagnetizing coil having a demagnetization region approximately equal to a non-sheet-passing region of a specific sheet width (as exemplary applications, see columns corresponding to the sheet widths larger than W1 and smaller than W2, larger than W3 and smaller than W4, and larger than W5 and smaller than W4 in the table shown in FIG. 8).

FIG. 7D shows an example of the control when the specific coil is a demagnetizing coil included in the sub-demagnetizing coil unit 82.

As shown in FIG. 7D, for example, when the recording sheet P having a sheet width larger than W2 and smaller than W3 passes, the control unit 60 switches on, as the specific coil, the second demagnetizing coil 822 included in the sub-demagnetizing coil unit 82, which corresponds to the non-sheet-passing region of the sheet width W3, and selects the first demagnetizing coil 811 included in the main demagnetizing coil unit 81 as the auxiliary coil.

In this example, since the specific coil is included in the sub-demagnetizing coil unit 82, for a similar reason to that in the example of the control shown in FIG. 7B, the second demagnetizing coil 812 included in the main demagnetizing coil unit 81 is selected as the complementary coil for complementing the demagnetization effects, and is switched on, along with the specific coil.

The first demagnetizing coil 811 set as the auxiliary coil is appropriately switched on or off, while the temperature in the non-demagnetization region of the fixing belt 51 (in this embodiment, the temperature at the detection location X2 shown in FIG. 5.) is checked (as exemplary applications, see columns corresponding to the sheet widths larger than W2 and smaller than W3, larger than W4 and smaller than W5, and larger than W5 in the table shown in FIG. 8).

As described above, when there is no demagnetizing coil having a demagnetization region approximately equal to the non-sheet-passing region, by selecting a demagnetizing coil having a demagnetization region a little larger than the non-sheet-passing region as the auxiliary coil and appropriately switching on or off the selected auxiliary coil, over-temperature in the non-sheet-passing region is suppressed accurately for almost all sizes.

In the case where the width of the recording sheet is smaller than W1, however, there is no demagnetizing coil having a demagnetization region larger than the non-sheet-passing region in this example, and thus the auxiliary coil cannot be provided (see a column corresponding to the sheet width smaller than W1 in the table shown in FIG. 8).

In this case, control may be performed so that, when the temperature in the non-demagnetization region reaches predetermined temperature, a warning to a user is displayed on a display unit of an operational panel (not illustrated), or execution of a print job is forced to be stopped.

Alternatively, for example, a moving range of a partition plate in the paper feed cassette may be limited or setting of a paper having the sheet width smaller than W1 may be disabled from the operation panel, so that a recording sheet having the sheet width smaller than W1 cannot be used.

Figure 9:
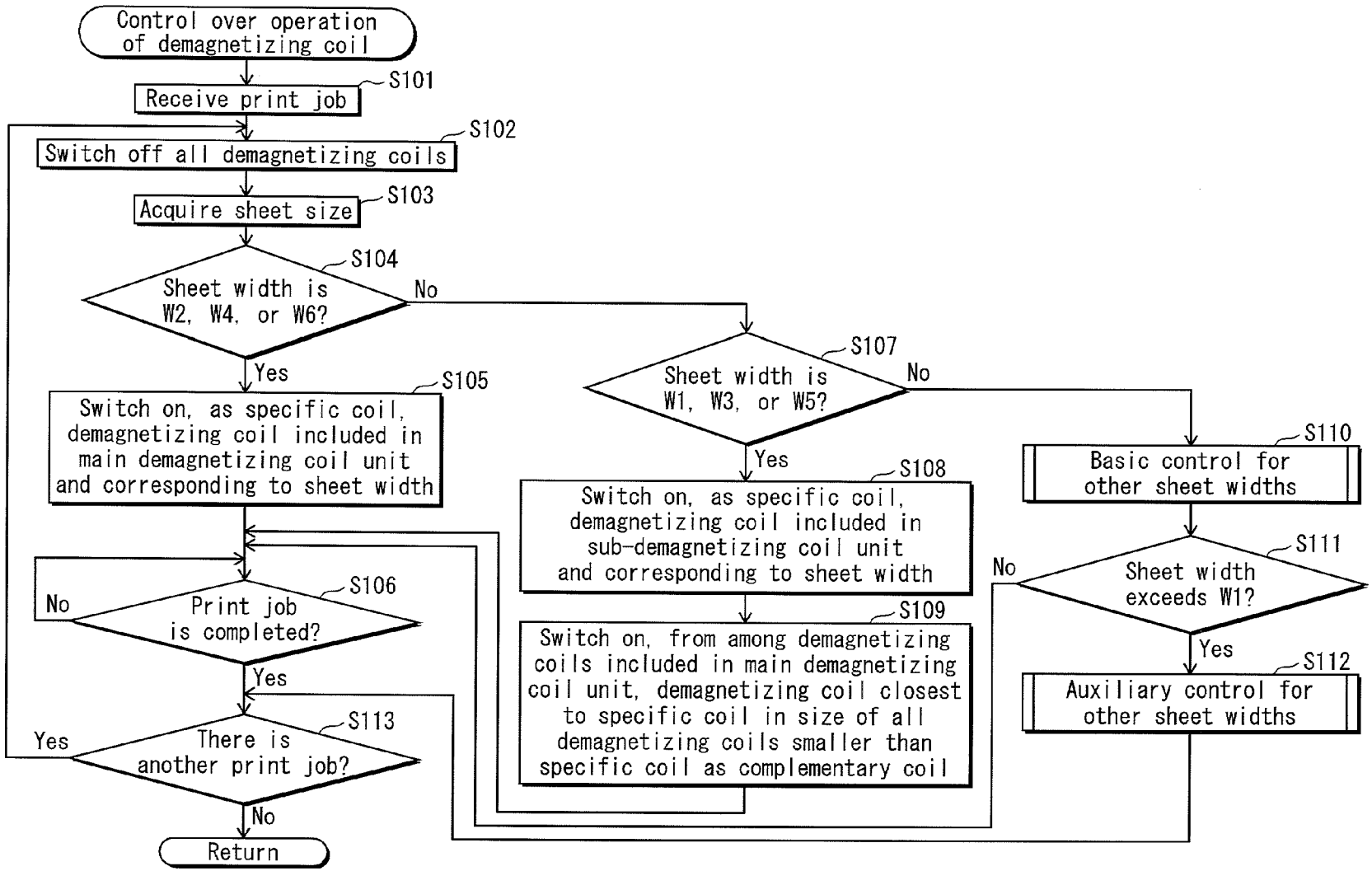
FIG. 9 is a flow chart showing the control over an operation of each demagnetizing coil performed by a control unit.

FIG. 9 is a flow chart showing control over an operation of each demagnetizing coil performed by the control unit 60. The control over an operation of each demagnetizing coil is normally performed, for example, during execution of an image forming job (print job) (at least during execution of a fixing operation by the fixing device), and is performed in parallel with drive control of the magnetizing coil 80 performed to maintain the temperature in the sheet-passing region of the fixing belt 51 at the fixing temperature based on an output of the temperature sensor 54.

As shown in FIG. 9, upon receiving a print job (step S101), the control unit 60 first switches off all the demagnetizing coils included in the main demagnetizing coil unit 81 and the sub-demagnetizing coil unit 82 to reset them (step S102), and acquires a sheet size (sheet width) from header information of the received print job (step S103).

When the acquired sheet width is any one of the sheet widths W2, W4, and W6 (step S104: Yes), the control unit 60 switches on an operation of a demagnetizing coil that is included in the main demagnetizing coil unit 81 and corresponds to a non-sheet-passing region of the acquired sheet width (i.e. a demagnetizing coil having a demagnetization region approximately equal to the non-sheet-passing region) as the specific coil, based on the table shown in FIG. 8 (step S105).

The operation of the specific coil is maintained to be switched on until the print job is completed (step S106: No).

When the acquired sheet width is any one of the sheet widths W1, W3, and W5 (step S104: No and step S107: Yes), the control unit 60 switches on an operation of a demagnetizing coil that is included in the sub-demagnetizing coil unit 82 and corresponds to the acquired sheet width, based on the table shown in FIG. 8 (step S108).

In this case, in addition to the specific coil included in the sub-demagnetizing coil unit 82, from among the demagnetizing coils included in the main demagnetizing coil unit 81, a demagnetizing coil that is the closest to the specific coil in size of all the demagnetizing coils smaller than the specific coil is selected and switched on as the complementary coil (step S109).

An operation of each demagnetizing coil switched on in the steps S108 and S109 is maintained until the print job is completed (step S106: No).

The acquired sheet width does not fall under any of the sheet widths W1 to W6 (step S104: No and step S107: No), the control unit 60 performs the basic control for other sheet widths (step S110), because there is no demagnetizing coil having a demagnetization region approximately equal to the non-sheet-passing region.

Figure 10:
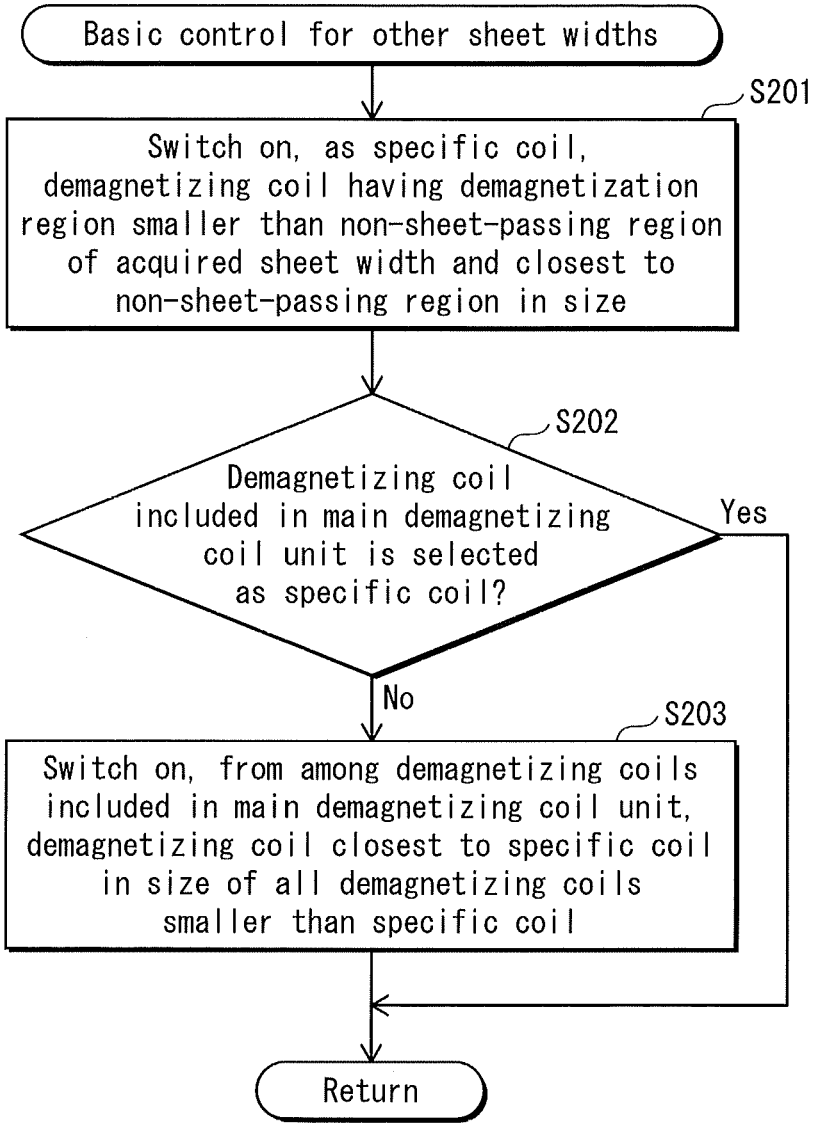
FIG. 10 is a flow chart showing a subroutine of basic control performed for other sheet widths.

FIG. 10 shows a subroutine of the basic control for the other sheet widths.

As shown in FIG. 10, the control unit 60 selects, as the specific coil, from among all the demagnetizing coils included in the main demagnetizing coil unit 81 and the sub-demagnetizing coil unit 82, a demagnetizing coil having a demagnetization region that is smaller than the non-sheet-passing region of the acquired sheet width and the closest to the non-sheet-passing region in size, based on the table shown in FIG. 8, and switches on an operation of the selected demagnetizing coil (step S201).

When a demagnetizing coil included in the main demagnetizing coil unit 81 is not selected as the specific coil in the step S201 (step S202: No), from among the demagnetizing coils included in the main demagnetizing coil unit 81, a demagnetizing coil that is the closest to the specific coil in size of all the demagnetizing coils smaller than the specific coil is selected as the complementary coil and switched on, with reference to the table shown in FIG. 8 (step S203).

When a demagnetizing coil included in the main demagnetizing coil unit 81 is selected as the specific coil (step S202: Yes), processing in the step S203 is skipped.

This concludes the basic control for the other sheet widths, and the flow chart shown in FIG. 9 is referred to again.

When the acquired sheet width exceeds the sheet width W1 after the basic control for the other sheet widths performed in the step S110 shown in FIG. 9 (step S111: Yes), the control unit 60 performs the auxiliary control for the other sheet widths (step S112).

When the acquired sheet width is smaller than the sheet width W1 (step S111: No), processing proceeds to the step S106, and an operation of each demagnetizing coil performed in the step S110 is maintained until the print job is completed, because there is no demagnetizing coil to be selected as the auxiliary coil as described above.

As described above, in this case, execution of the print job may be forced to be stopped or a print job may be prohibited from being started, based on the temperature detected in the non-demagnetization region.

Figure 11:
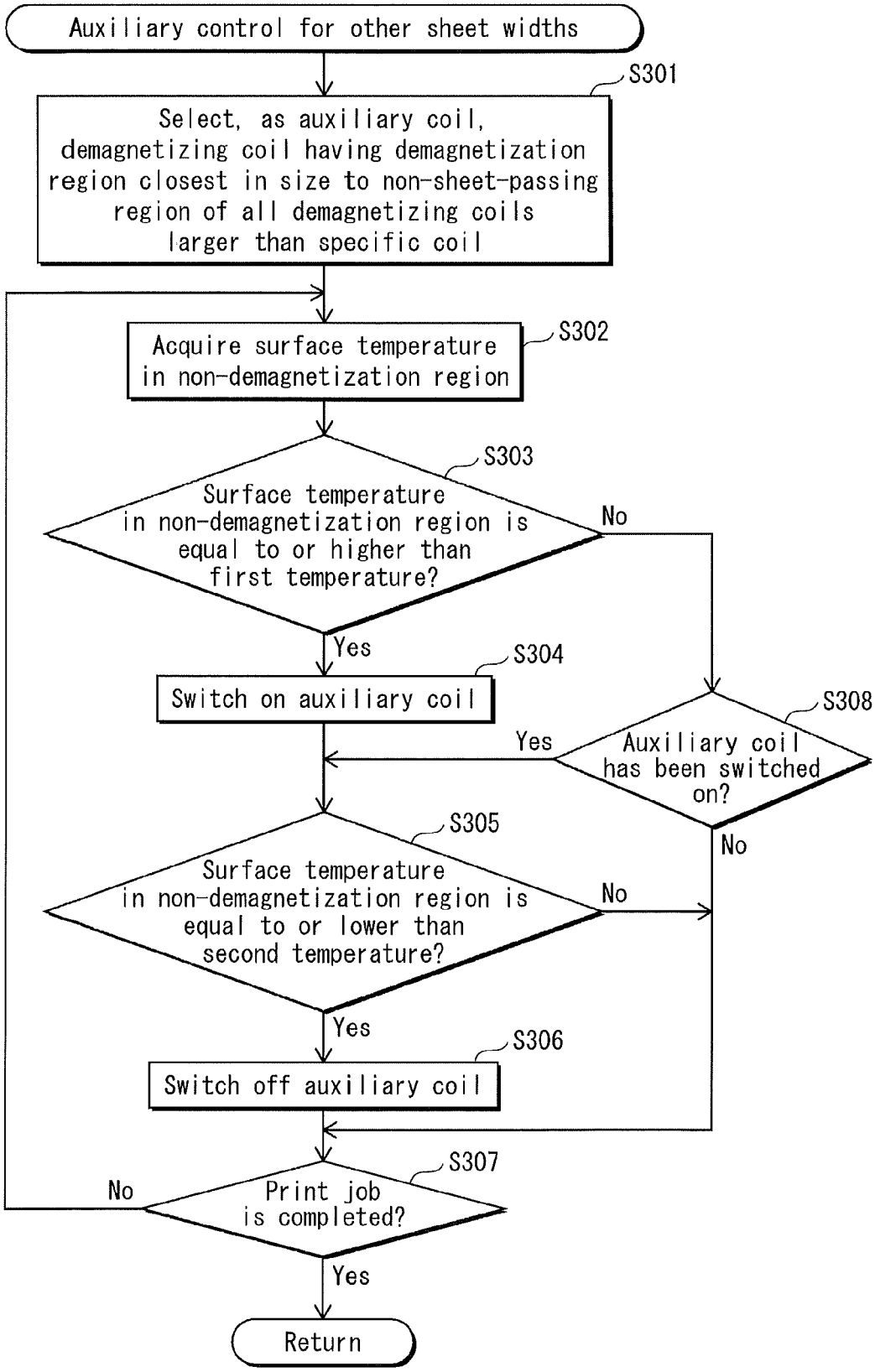
FIG. 11 is a flow chart showing a subroutine of auxiliary control performed for other sheet widths.

FIG. 11 shows a subroutine of the auxiliary control for the other sheet widths performed in the step S112 shown in FIG. 9.

In the step S301, the control unit 60 first selects, as the auxiliary coil, from among the demagnetizing coils included in the main demagnetizing coil unit 81 and the sub-demagnetizing coil unit 82, a demagnetizing coil having a demagnetization region closest in size to the non-sheet-passing region of all the demagnetizing coils larger than the specific coil selected in the step S110.

The control unit 60 then acquires, from among values detected by the temperature sensor 55, surface temperature in the non-demagnetization region determined by a combination of the specific coil and the auxiliary coil (step S302), and switches on the auxiliary coil (step S304) when the acquired temperature is equal to or higher than first temperature (step S303: YES).

According to FIG. 8, when the sheet width is specified, the specific coil and the auxiliary coil are specified accordingly, and the non-demagnetization region is also determined by a combination of the specified specific coil and auxiliary coil. Therefore, for example, by preparing in advance a table showing a correspondence between the sheet width and a value detected at any of the detection locations X1 to X5 that corresponds to the non-demagnetization region from among values detected by the temperature sensor 55, and storing the prepared table in nonvolatile memory, such as ROM, included in the control unit 60, the surface temperature in the non-demagnetization region is acquired smoothly in the step S302.

Since the temperature in the non-demagnetization region should be the highest of all regions included in the non-sheet-passing region, the highest temperature detected at any of the detection locations X1 to X5 may be specified as the surface temperature in the non-demagnetization region.

In this embodiment, the first temperature is set to be higher than the fixing temperature (e.g. 180° C.) and be predetermined temperature lower than heat resistance temperature of the fixing belt. It is preferred that the predetermined temperature be approximately 0° C. to 60° C., considering a safety factor. In this embodiment, the first temperature is set to be 220° C., for example.

When the surface temperature in the non-demagnetization region decreases and becomes equal to or lower than second temperature due to demagnetization performed by the auxiliary coil (step S305: YES), an operation of the auxiliary coil is switched off (step S306).

The second temperature is set to be lower than the above-mentioned first temperature and higher than the fixing temperature. Since the demagnetization region of the auxiliary coil partially overlaps an end portion of the sheet-passing region, if the second temperature is set to be extremely low, temperature in an end portion of a passing sheet becomes lower than the fixing temperature, and this can lead to poor fixing. To prevent such a problem, temperature that does not cause poor fixing is acquired in advance in experiments, and stored in ROM included in the control unit 60. In this embodiment, the second temperature is set to be approximately 210° C.

When the surface temperature in the non-demagnetization region is not equal to or higher than the first temperature (step S303: NO) and an operation of the auxiliary coil has already been switched on (step S308: YES), the processing proceeds to the step S305 (the processing in the step S304 is skipped). On the other hand, when the operation of the auxiliary coil has not been switched on (step S308: NO), the processing proceeds to the step S307 (the processing in the steps S304 to S306 is skipped).

When the surface temperature in the non-demagnetization region is not equal to or lower than the second temperature in the step S305 (step S305: NO), processing in the step S306 is skipped and the operation of the auxiliary coil is not switched off.

The above-mentioned control is repeated until the print job is completed (step S307: NO, steps S302 to S306). Once the print job is completed (step S307: YES), the flow chart is completed and processing is returned to the flow chart shown in FIG. 9.

Whether there is another print job or not is judged in a step S113 shown in FIG. 9. When there is the other print job (step S113: YES), processing is returned to the step S102 and the above-mentioned processing is repeated. When there is no other print job (step S113: NO), the control over the operation of the demagnetizing coil is completed.

According to the fixing device in the above-mentioned embodiment, by placing the sub-demagnetizing coil unit 82 on the main demagnetizing coil unit 81, an increase in the size of the device due to an increase in the number of demagnetizing coils is prevented as much as possible. In addition, by controlling operations of the demagnetizing coils as described above, the demagnetization effects are obtained for recording sheets of a wide variety of sizes, and thus over-temperature in the non-sheet-passing region is accurately suppressed.

Modifications

Although the present invention has been described based on the above-mentioned embodiment, it is obvious that the present invention is not limited to the above-mentioned embodiment. The following modifications also fall within a scope of the present invention.

(1) The number, sizes, and layout of the demagnetizing coil units and the demagnetizing coils are not limited to those described in the above-mentioned embodiment, and may appropriately be selected according to the specifications for the fixing belt and the fixing unit.

For example, the number of demagnetizing coils included in the main demagnetizing coil unit 81 and the number of demagnetizing coils included in the sub-demagnetizing coil unit 82 are both set to be three in the above-mentioned embodiment, but may be different from each other.

Although all the demagnetizing coils included in the main demagnetizing coil unit 81 and the sub-demagnetizing coil unit 82 are different in size in the above-mentioned embodiment, demagnetizing coils having the same size may be included. As long as at least one demagnetizing coil included in each demagnetizing coil unit is different in size from any of the demagnetizing coils included in the other one or more demagnetizing coil units so that a combination of the demagnetizing coils differs among the demagnetizing coil units, a size of a recording sheet that is not supported by one demagnetizing coil unit can be supported by another demagnetizing coil unit. On the other hand, demagnetizing coils of the same size included in different demagnetizing coil units have the advantage that the demagnetization efficiency is increased by being operated together.

The structure of piling the demagnetizing coil units is not limited to the structure in which the sub-demagnetizing coil unit 82 is placed on the main demagnetizing coil unit 81, and may be the structure in which one or more demagnetizing coils units are further placed on the sub-demagnetizing coil unit 82.

In this case, when a demagnetizing coil corresponding to a size of a passing recording sheet is included in a demagnetizing coil unit at the third or higher tier, it is preferred to switch on an operation of the corresponding demagnetizing coil, and to also select, from among demagnetizing coils included in one or more demagnetizing coil units each at a tier lower than the third or higher tier, the largest demagnetizing coil of all the demagnetizing coils smaller than the corresponding demagnetizing coil as the complementary coil and switch on an operation of the selected demagnetizing coil. It is more preferred to select, from among demagnetizing coils that are included in a demagnetizing coil unit at the first tier, which is the closest to the magnetizing coil, the largest demagnetizing coil of all magnetizing coils smaller than the corresponding demagnetizing coil and switch on an operation of the selected demagnetizing coil. This is because the demagnetization efficiency is further increased.

(2) Although a pile of the main demagnetizing coil unit 81 and the sub-demagnetizing coil unit 82 is placed on a side of the magnetizing coil 80 opposite the fixing belt 51 in the above-mentioned embodiment, the structure of placing the pile is not limited to this. The pile of the main demagnetizing coil unit 81 and the sub-demagnetizing coil unit 82 may be disposed between the magnetizing coil 80 and the fixing belt 51.

(3) Although the temperature sensor 54 for detecting the surface temperature in the sheet-passing region of the fixing belt 51 includes the non-contact type thermistor, and the temperature sensor 55 for detecting the surface temperature in the non-sheet-passing region of the fixing belt 51 includes the infrared detection type thermopile array in the above-mentioned embodiment, the structure of each temperature sensor is not limited to this.

As a temperature sensor for detecting the surface temperature in the sheet-passing region, an infrared detection type thermopile or thermopile array may be used, for example. The thermopile array has a wide viewing angle and is thus capable of measuring temperature at a plurality of locations. If the thermopile array detects temperature at a plurality of locations in the sheet-passing region, control over the surface temperature of the fixing belt 51 is performed more accurately. The thermopile array is therefore useful.

As a temperature sensor for detecting the surface temperature in the non-sheet-passing region, a non-contact type thermistor, an infrared detection type thermopile or the like may be used. In this case, however, it is necessary to provide a plurality of temperature sensors or to provide a movable temperature sensor in order to detect temperature at a plurality of locations in the non-sheet-passing region as described in the above-mentioned embodiment.

(4) In a case where one temperature sensor for detecting the surface temperature at particular one location in the non-sheet-passing region (hereinafter, referred to as "end portion temperature") is provided, it is possible to estimate the temperature in the non-demagnetization region described above.

That is to say, as long as the temperature in the sheet-passing region, the end portion temperature, and the sheet width are determined, it is possible to specify temperature distribution (a temperature distribution curve) on the fixing belt 51 in a direction along the rotational axis J, and to estimate temperature at other locations in the non-sheet-passing region by using the specified temperature distribution.

Figure 12:
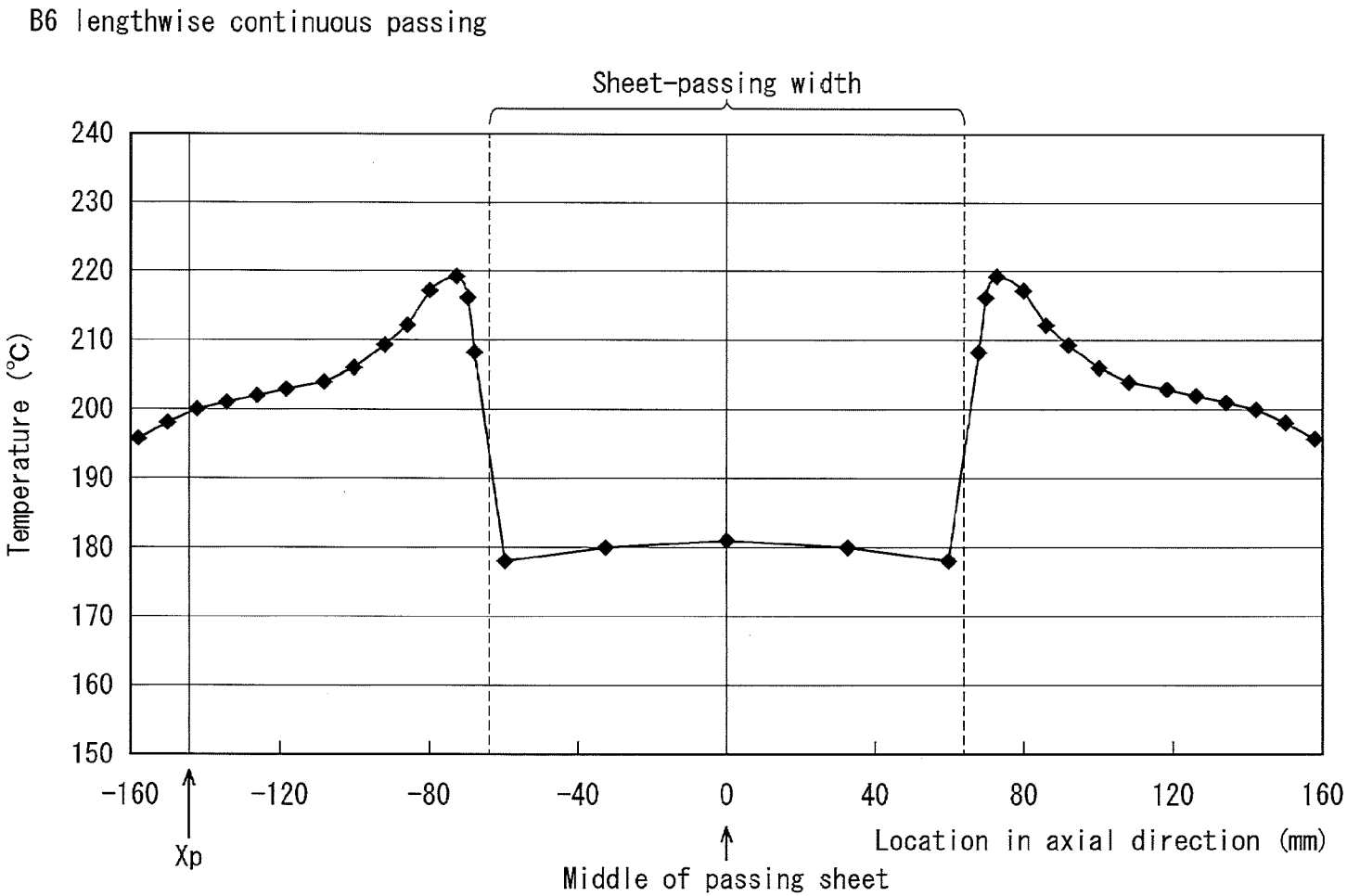
FIG. 12 shows an example of surface temperature distribution on the fixing belt.

FIG. 12 shows an example of the temperature distribution curve when the temperature at a location Xp in an end portion of the fixing belt 51 is approximately 199° C. and the temperature in the sheet-passing region is maintained to fixing temperature 180° C. in a case where a passing recording sheet is a plain paper and a sheet width thereof corresponds to B6 lengthwise shown in FIG. 8 (the auxiliary coil is switched off).

According to FIG. 12, although an increase in temperature is suppressed in a region corresponding to the specific coil due to the demagnetization effects of the specific coil, temperature increases in the non-demagnetization region adjacent to the region corresponding to the specific coil.

As the temperature in the non-demagnetization region increases, temperature increases due to heat conduction in a region adjacent to the non-demagnetization region, and thus the end portion temperature increases. This means that, if the temperature distribution curve when temperature at a target location in the non-demagnetization region reaches the first temperature (220° C.) is acquired in advance for each sheet width, and the end portion temperature at the detection location Xp when the temperature at the target location reaches the first temperature is stored along with a corresponding sheet width in the ROM included in the control unit 60, whether or not the temperature in the non-demagnetization region reaches the first temperature can be estimated only from the end portion temperature and the sheet width.

The end portion temperature at the detection location Xp when the temperature at the target location in the non-demagnetization region decreases and reaches the second temperature may be acquired by operating the specific coil and the auxiliary coil, and stored in the ROM in a similar manner.

By doing so, control may be performed by proving only one inexpensive temperature sensor for detecting temperature at one detection location in the non-sheet-passing region in a cost effective manner.

It is preferred that the above-mentioned temperature distribution curve be acquired for each type of a recording sheet.

Since the amount of heat extracted from a recording sheet in the sheet-passing region of the fixing belt varies depending on a thickness and surface treatment of a paper, such as a plain paper, a thick paper, a thin paper, an OHP sheet, and a glossy paper, a thermal effect on the non-sheet-passing region varies accordingly.

Information relating to the type of the recording sheet is acquired by extracting the information relating to a sheet size designated by a user from the header information of a print job, or by being input from a user via an operational panel when the recording sheet P is set in the paper feed cassette. The control unit 60 therefore can acquire information relating to the width and the type of the recording sheet in the above-mentioned manner, and estimate the temperature in the non-demagnetization region based on the preset temperature distribution curve or a threshold value of the end portion temperature to perform on-off control over the auxiliary coil.

(5) Although the fixing belt 51 includes the metal heat generation layer 511, the elastic layer 512, and the release layer 513 arranged in this order in the above-mentioned embodiment, the structure of the fixing belt 51 is not limited to this. The structure of the fixing belt 51 may appropriately be selected according to the specifications for the fixing unit.

(6) Although the fixing rotating body includes the fixing belt 51 having the metal heat generation layer 511, and the fixing roller 52 inserted into the fixing belt 51 with clearance in the above-mentioned embodiment, the structure of the fixing rotating body is not limited this. For example, the fixing roller 52 may be tightly fit into the fixing belt 51. Instead of a roller body, an elongated pressure member that receives pressure applied by the pressing roller 53 may be inserted into the fixing belt.

(7) Although the pressing roller 53 is used as a pressing member pressing against the fixing belt 51 to form the fixing nip N in the above-mentioned embodiment, the structure of the pressing roller 53 is not limited this. Instead of the pressing roller 53, an elongated pad member may be used to press against the fixing roller 52 via the fixing belt 51, for example.

(8) Although the main core 84 and the sub-cores 85 form a magnetic circuit along with the magnetizing coil 80 and the fixing belt 51 in the above-mentioned embodiment, core members (end cores) may further be provided at both ends of the fixing belt 51 in a longitudinal direction thereof within the loop of the magnetizing coil 80.

An alternating field generated by the magnetizing coil is less likely to be distributed to the both ends of the fixing belt 51 in a direction along the rotational axis thereof, and heat is more likely to be released externally from the ends of the fixing belt 51. Therefore, by providing the above-mentioned end cores to increase magnetic flux density at the both ends of the fixing belt 51, it is possible to prevent poor fixing at both ends of a passing recording sheet having a maximum size in the width direction thereof.

(9) Although one paper feed cassette is provided in the above-mentioned embodiment, the number of paper feed cassettes may not be limited to one. A plurality of paper feed cassettes may be provided.

(10) In the above-mentioned embodiment, explanation on the control over an operation of each demagnetizing coil is made on the assumption that the width of a recording sheet does not change in one print job, with use of the flow chart shown in FIG. 9. The width of a recording sheet, however, may change in one print job. When a plurality of paper feed cassettes are provided as described in the above-mentioned section (9), and recording sheets having different sheet widths are printed in one print job, processing may be returned to the step S103 shown in FIG. 9 to acquire a sheet size (sheet width) each time one recording sheet is printed, and the subsequent processing in the steps S104 to S112 may be repeated.

(11) Although explanation is made by using the tandem-type color printer as the image forming device in the above-mentioned embodiment, the present invention is also applicable to a copier, a facsimile machine, a printer, and the like each having an electromagnetic induction-type fixing unit.

The above-mentioned embodiment and modifications may be combined one another if at all possible.

SUMMARY

The above-mentioned embodiment and modifications each show one aspect of the invention to solve the problems presented in the Description of Related Art section. The above-mentioned embodiment and modifications may be summarized as follows:

A fixing device pertaining to one aspect of the present invention is a fixing device comprising: a fixing rotating body; a magnetizing coil disposed along a direction of a rotational axis of the fixing rotating body, and configured to heat the fixing rotating body by induction; a pressing member pressing against an outer circumferential surface of the fixing rotating body to form a fixing nip through which a recording sheet with an unfixed image formed thereon passes; a demagnetizing coil unit set including a pile of two or more demagnetizing coil units, each demagnetizing coil unit including a plurality of demagnetizing coils of different sizes, and being configured to cancel out part of magnetic flux generated by the magnetizing coil in a region corresponding to a non-sheet-passing region of the fixing rotating body; a sheet information acquisition unit configured to acquire sheet information including information relating to a width of the recording sheet; and an operation control unit configured to control an operation of each of the demagnetizing coils according to the width of the recording sheet, wherein in each demagnetizing coil unit, the demagnetizing coils are arranged such that a smaller demagnetizing coil is surrounded by a larger demagnetizing coil and that the demagnetizing coils are in a same plane extending along a surface of the magnetizing coil, and a combination of sizes of the demagnetizing coils differs among the demagnetizing coil units.

All the demagnetizing coils included in the demagnetizing coil units may be different in size.

A combination of the demagnetizing coils included in each of the demagnetizing coil units may have been determined such that all the demagnetizing coils are allocated in turn to each of the demagnetizing coil units in order of size, starting from a largest demagnetizing coil.

During fixing, the operation control unit may operate one of the demagnetizing coils having a size corresponding to a size of the non-sheet-passing region determined according to the width of the recording sheet, and when the operated demagnetizing coil is included in a demagnetizing coil unit at a second or higher tier of the demagnetizing coil unit set, the operation control unit may further operate, from among demagnetizing coils included in one or more demagnetizing coil units each at a tier lower than the second or higher tier, a largest demagnetizing coil of all demagnetizing coils smaller than the operated demagnetizing coil.

The fixing device may further comprises a temperature distribution acquisition unit configured to acquire information relating to surface temperature distribution on the fixing rotating body in the direction of the rotational axis at least in the non-sheet-passing region in a case where the recording sheet having a minimum width passes, and the operation control unit may control the operation according to the width of the recording sheet and the acquired information relating to the surface temperature distribution.

The temperature distribution acquisition unit may include a first temperature detection unit for detecting surface temperature in a middle portion of the fixing rotating body, and a second detection unit for detecting surface temperature in an end portion of the fixing rotating body in the direction of the rotational axis, and the information relating to the surface temperature distribution may be acquired based on the surface temperature detected by the first temperature detection unit, the surface temperature detected by the second temperature detection unit, and the width of the recording sheet.

The sheet information may further include information relating to a type of the recording sheet, and the information relating to the surface temperature distribution may be acquired based on the surface temperature detected by the first temperature detection unit, the surface temperature detected by the second temperature detection unit, the width of the recording sheet, and the type of the recording sheet.

According to the fixing device having the above-mentioned configuration, in each demagnetizing coil unit, the demagnetizing coils are arranged such that a smaller demagnetizing coil is surrounded by a larger demagnetizing coil and that the demagnetizing coils are in the same plane extending along the surface of the magnetizing coil, and two or more demagnetizing coil units are piled. Compared to a case where demagnetizing coils of different sizes are simply placed on top of each other to form a pile of the demagnetizing coils as disclosed in the first prior art, the number of demagnetizing coils placed on top of each other can be reduced significantly, and no demagnetizing coil is extremely remote from the magnetizing coil. With the above-mentioned configuration, predetermined demagnetization efficiency is ensured, and the device can be made smaller, as it is possible to support recording sheets of a wider variety of sizes with a smaller number of demagnetizing coils placed on top of each other.

In addition, since two or more demagnetizing coils are piled, it is possible to prevent the width of the surrounding demagnetizing coils from increasing in a circumferential direction of the fixing rotating body to increase a size of the device without the need of increasing the number of sizes applied in one demagnetizing coil unit.

Over-temperature in the non-sheet-passing region determined according to recording sheets of a wide variety of sizes is therefore effectively suppressed without increasing the size of the device compared to the conventional technology.

The present invention may be an image forming device comprising the fixing device having the above-mentioned configuration. The image forming device can achieve similar effects to the fixing device having the above-mentioned configuration.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device comprising:

a fixing rotating body;

a magnetizing coil disposed along a direction of a rotational axis of the fixing rotating body, and configured to heat the fixing rotating body by induction;

a pressing member pressing against an outer circumferential surface of the fixing rotating body to form a fixing nip through which a recording sheet with an unfixed image formed thereon passes;

a demagnetizing coil unit set including a pile of two or more demagnetizing coil units, each demagnetizing coil unit including a plurality of demagnetizing coils of different sizes, and being configured to cancel out part of magnetic flux generated by the magnetizing coil in a region corresponding to a non-sheet-passing region of the fixing rotating body;

a sheet information acquisition unit configured to acquire sheet information including information relating to a width of the recording sheet; and an operation control unit configured to control an operation of each of the demagnetizing coils according to the width of the recording sheet, wherein in each demagnetizing coil unit, the demagnetizing coils are arranged such that a smaller demagnetizing coil is surrounded by a larger demagnetizing coil and that the demagnetizing coils are in a same plane extending along a surface of the magnetizing coil, and a combination of sizes of the demagnetizing coils differs among the demagnetizing coil units.

2. The fixing device of claim 1, wherein all the demagnetizing coils included in the demagnetizing coil units are different in size.

3. The fixing device of claim 2, wherein a combination of the demagnetizing coils included in each of the demagnetizing coil units has been determined such that all the demagnetizing coils are allocated in turn to each of the demagnetizing coil units in order of size, starting from a largest demagnetizing coil.

4. The fixing device of claim 1, wherein during fixing, the operation control unit operates one of the demagnetizing coils having a size corresponding to a size of the non-sheet-passing region determined according to the width of the recording sheet, and when the operated demagnetizing coil is included in a demagnetizing coil unit at a second or higher tier of the demagnetizing coil unit set, the operation control unit further operates, from among demagnetizing coils included in one or more demagnetizing coil units each at a tier lower than the second or higher tier, a largest demagnetizing coil of all demagnetizing coils smaller than the operated demagnetizing coil.

5. The fixing device of claim 1 further comprising a temperature distribution acquisition unit configured to acquire information relating to surface temperature distribution on the fixing rotating body in the direction of the rotational axis at least in the non-sheet-passing region in a case where the recording sheet having a minimum width passes, and the operation control unit controls the operation according to the width of the recording sheet and the acquired information relating to the surface temperature distribution.

6. The fixing device of claim 5, wherein the temperature distribution acquisition unit includes a first temperature detection unit for detecting surface temperature in a middle portion of the fixing rotating body, and a second detection unit for detecting surface temperature in an end portion of the fixing rotating body in the direction of the rotational axis, and the information relating to the surface temperature distribution is acquired based on the surface temperature detected by the first temperature detection unit, the surface temperature detected by the second temperature detection unit, and the width of the recording sheet.

7. The fixing device of claim 6, wherein the sheet information further includes information relating to a type of the recording sheet, and the information relating to the surface temperature distribution is acquired based on the surface temperature detected by the first temperature detection unit, the surface temperature detected by the second temperature detection unit, the width of the recording sheet, and the type of the recording sheet.

8. An image forming device comprising the fixing device of claim 1.

* * * * *